US011251525B2

(12) United States Patent
Holyoak et al.

(10) Patent No.: US 11,251,525 B2
(45) Date of Patent: Feb. 15, 2022

(54) MULTI-BAND, DUAL-POLARIZATION ANTENNA ARRAY

(71) Applicant: Nokia Solutions and Networks Oy, Espoo (FI)

(72) Inventors: Michael Jarret Holyoak, Whippany, NJ (US); Shahriar Shahramian, Warren, NJ (US)

(73) Assignee: Nokia Solutions and Networks OY, Espoo (FI)

( * ) Notice: Subject to any disclaimer, the term of this patent is extended or adjusted under 35 U.S.C. 154(b) by 266 days.

(21) Appl. No.: 16/437,525

(22) Filed: Jun. 11, 2019

(65) Prior Publication Data

US 2020/0395665 A1 Dec. 17, 2020

(51) Int. Cl.

| | |
|---|---|
| ***H01Q 21/06*** | (2006.01) |
| ***H01Q 5/28*** | (2015.01) |
| ***H01Q 5/307*** | (2015.01) |
| ***H01Q 21/24*** | (2006.01) |
| ***H01Q 9/04*** | (2006.01) |
| ***H01Q 5/35*** | (2015.01) |

(52) U.S. Cl.
CPC ..... *H01Q 5/28* (2015.01); *H01Q 5/307* (2015.01); *H01Q 5/35* (2015.01); *H01Q 9/0457* (2013.01); *H01Q 21/065* (2013.01); *H01Q 21/24* (2013.01)

(58) Field of Classification Search
CPC ..... H01Q 5/28; H01Q 21/065
See application file for complete search history.

(56) References Cited

U.S. PATENT DOCUMENTS

| | | | |
|---|---|---|---|
| 5,241,321 | A | 8/1993 | Tsao |
| 2014/0203995 | A1 | 7/2014 | Romney et al. |
| 2014/0210486 | A1 | 7/2014 | Dijkstra |
| 2017/0054211 | A1 | 2/2017 | Gallagher et al. |
| 2019/0020121 | A1 | 1/2019 | Paulotto et al. |

(Continued)

OTHER PUBLICATIONS

Extended European Search Report for corresponding European application No. 20177923.8; dated Nov. 2, 2020 (13 pages).

(Continued)

*Primary Examiner* — Daniel Munoz
(74) *Attorney, Agent, or Firm* — Mendelsohn Dunleavy, P.C.; Steve Mendelsohn

(57) ABSTRACT

In certain embodiments, a two-dimensional antenna block has (at least) two different types of dual-band, dual-polarization patch antennas that support (at least) two different frequency bands in the same polarization direction, where each feed line in the antenna block supports only one frequency band. Quad-band antenna blocks, having three different types of patch antennas supporting three different frequency bands in a first polarization direction and a common frequency band in a second polarization direction, can be tiled to form larger, quad-band antenna arrays. A particular (4×4) antenna block has, in the first polarization direction, eight antennas supporting a first frequency band, four antennas supporting a second frequency band, and four antennas supporting a third frequency band, where all sixteen antennas support the common frequency band. In a PCB implementation, three IC chips are mounted onto the bottom of the PCB to support antenna block communication and/or imaging operations.

16 Claims, 15 Drawing Sheets

(56) References Cited

U.S. PATENT DOCUMENTS

| | | | | |
|---|---|---|---|---|
| 2019/0036231 | A1 | 1/2019 | Ryu et al. | |
| 2019/0081414 | A1* | 3/2019 | Kao | H01Q 5/42 |
| 2019/0148839 | A1* | 5/2019 | Lin | H01Q 21/24 343/700 R |
| 2020/0403322 | A1* | 12/2020 | Ryu | H01Q 3/26 |

OTHER PUBLICATIONS

Han, Minseok et al. "Dual Polarized Array Antenna for S/X Band Active Phased Array Radar Application," Journal of the Korean Institute of Electromagnetic Engineering and Science, Dec. 2010, pp. 309-315, vol. 10, No. 4, Korean Institute of Electromagnetic Engineering and Science, Korea.

Ortiz, Javier A. et al. "Ultra-Compact Universal Polarization X-band Unit Cell for High-Performance Active Phased Array Radar," 2016 IEEE International Symposium on Phased Array Systems and Technology (PAST), 2016, pp. 1-5, IEEE, USA.

Elahi, Manzoor et al. "A Quad-Band CPW Fed Slot Antenna Array for LTE and WiMAX Applications," Progress In Electromagnetics Research M, 2017, pp. 159-167, vol. 61.

Valdes-Garcia, Alberto "Millimeter-Wave Phased Array for 5G," IBM Research, 2018, pp. 1-49, IBM T.J. Watson Research Center, New York, USA.

Zhai, Wenyao "Dual-Band Millimeter-Wave Interleaved Antenna Array Exploiting Low-Cost PCB Technology for High Speed 5G Communication," 2016, IEEE MTT-S International Microwave Symposium (IMS), 2016, pp. 1-4, IEEE, USA.

Tsao, C.H. et al. "Aperture-coupled Patch Antennas with Wide-bandwidth and Dual-polarization Capabilities," 1988, pp. 936-939, IEEE.

* cited by examiner

300

400

MULTI-BAND, DUAL-POLARIZATION ANTENNA ARRAY

BACKGROUND

Field of the Invention

The present disclosure relates to antenna arrays for communication and/or imaging applications.

Description of the Related Art

This section introduces aspects that may help facilitate a better understanding of the disclosure. Accordingly, the statements of this section are to be read in this light and are not to be understood as admissions about what is prior art or what is not prior art.

It is known to use arrays of antenna elements for communication and imaging applications. In communication applications, new generations of mobile technology typically involve higher data rates that must be supported by the hardware for that mobile technology, including the antennas used to transmit and receive the associated wireless communication signals.

SUMMARY

In one embodiment, the present disclosure is an antenna block comprising a substrate, one or more instances of a first type of dual-band, dual-polarization patch antenna formed on the substrate, one or more instances of a second type of dual-band, dual-polarization patch antenna formed on the substrate, a first feed line formed on the substrate, and a different, second feed line formed on the substrate. The first type of patch antenna is configured to support a first frequency band in a first polarization direction and a first frequency band in a second polarization direction, wherein the first frequency band in the first polarization direction is different from the first frequency band in the second polarization direction. The second type of patch antenna is configured to support a second frequency band in the first polarization direction and a second frequency band in the second polarization direction, wherein (i) the second frequency band in the second polarization direction is different from the second frequency band in the first polarization direction and (ii) the second frequency band in the first polarization direction is different from the first frequency band in the first polarization direction. The first feed line is connected to support the first frequency band in the first polarization direction, and the second feed line is connected to support the second frequency band in the first polarization direction.

BRIEF DESCRIPTION OF THE DRAWINGS

Embodiments of the disclosure will become more fully apparent from the following detailed description, the appended claims, and the accompanying drawings in which like reference numerals identify similar or identical elements.

As used herein, the term "X-ray" implies that the corresponding figure shows features that would not all be visible from an exterior view or a single cross-sectional view.

DETAILED DESCRIPTION

Detailed illustrative embodiments of the present disclosure are disclosed herein. However, specific structural and functional details disclosed herein are merely representative for purposes of describing example embodiments of the present disclosure. The present disclosure may be embodied in many alternate forms and should not be construed as limited to only the embodiments set forth herein. Further, the terminology used herein is for the purpose of describing particular embodiments only and is not intended to be limiting of example embodiments of the disclosure.

As used herein, the singular forms "a," "an," and "the," are intended to include the plural forms as well, unless the context clearly indicates otherwise. It further will be understood that the terms "comprises," "comprising," "includes," and/or "including," specify the presence of stated features, steps, or components, but do not preclude the presence or addition of one or more other features, steps, or components. It also should be noted that in some alternative implementations, the functions/acts noted may occur out of the order noted in the figures. For example, two figures shown in succession may in fact be executed substantially concurrently or may sometimes be executed in the reverse order, depending upon the functions/acts involved.

Figure 1:
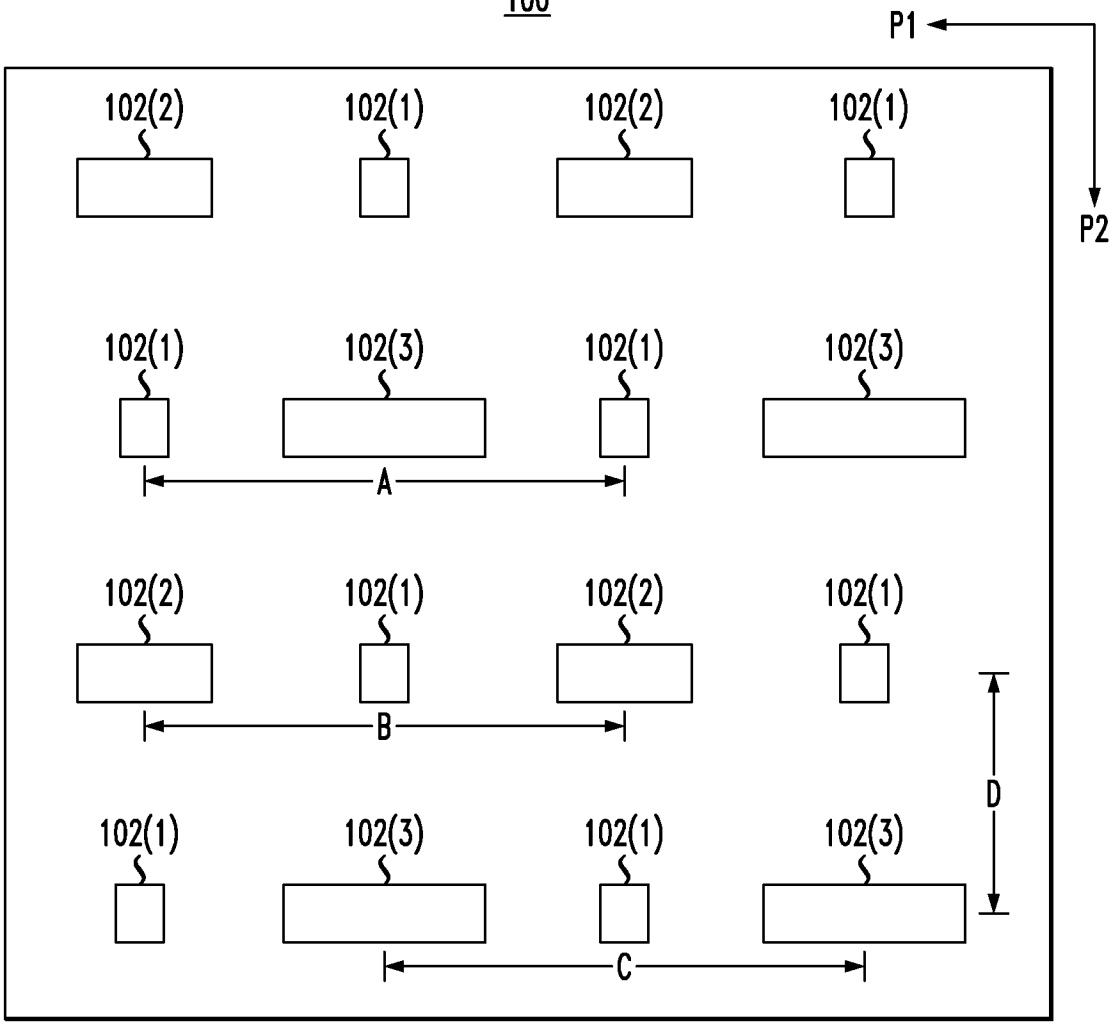
FIG. 1 is a schematic plan view of an antenna block of sixteen patch antennas arranged in a (4×4) pattern according to one embodiment.

FIG. 1 is a plan view of an antenna block 100 of sixteen patch antennas 102 arranged in a (4×4) pattern according to one embodiment. As shown in FIG. 1, the antenna block 100 has:

- Eight instances of a first type of patch antenna 102(1), which is designed to support wireless signals in a first frequency band centered about 95 GHz in a first polarization (P1) direction and wireless signals in a common frequency band centered about 60 GHz in a second polarization (P2) direction that is orthogonal to the first polarization direction, where the first and second polarization directions are different from the propagation direction of the wireless signals;
- Four instances of a second type of patch antenna 102(2), which is designed to support wireless signals in a second frequency band centered about 39 GHz in the first polarization direction and wireless signals in the common frequency band in the second polarization direction; and
- Four instances of a third type of patch antenna 102(3), which is designed to support wireless signals in a third frequency band centered about 28 GHz in the first polarization direction and wireless signals in the common frequency band in the second polarization direction.

Thus, in the antenna block 100:

Each patch antenna 102 is a dual-band, dual-polarization element that supports two different frequency bands: one in the first polarization direction and the other in the second polarization direction;

The antenna block 100 has three different types of patch antennas 102, each of which supports a different frequency band in the first polarization direction (i.e., one of the first, second, and third frequency bands in the first polarization direction) and the same frequency band in the second polarization direction (i.e., the common frequency band in the second polarization direction); and The antenna block 100 is a quad-band structure that supports four different frequency bands.

As understood by those skilled in the art, the length and width dimensions of the structure used to form each patch antenna 102 determine the two frequency bands at which a dual-band, dual-polarization patch antenna 102 is designed to operate, where larger dimensions imply lower frequencies. In the context of FIG. 1, "length" refers to the dimension in the first polarization direction and "width" refers to the dimension in the second polarization direction. Thus, in the antenna block 100 of FIG. 1, the first type of patch antenna 102(1), which operates at the highest frequency band in the first polarization direction, has the smallest length, and the third type of patch antenna 102(3), which operates at the lowest frequency band in the first polarization direction, has the largest length, while the three types of patch antennas 102(1)-102(3), all of which operate at the common frequency band in the second polarization direction, have the same width.

As understood by those skilled in the art, the antenna block 100 has feed lines (not shown in FIG. 1) that carry electronic (i.e., wired) signals between each of the different patch antennas 102 and electronic circuitry (not shown in FIG. 1) that supports the operations of the antenna block 100, where each feed line in the antenna block 100 is configured to carry only one frequency band. Thus, each patch antenna 102 is connected to two different feed lines, one feed line for the patch's frequency band in the first polarization direction and a different feed line for the common frequency band in the second polarization direction.

In some implementations, the antenna block 100 is implemented as a printed circuit board (PCB) device on a PCB substrate, where one or more integrated circuit (IC) chips that provide the electronic circuitry to support the operations of the antenna block are mounted onto the bottom of the PCB. In other implementations, the antenna block 100 may be implemented using any other suitable substrate, including (without limitation) glass or semiconductor. Note that, when the antenna block 100 is implemented on a semiconductor substrate as an integrated device, the electronic circuitry that supports the operations of that antenna block may be implemented on that same semiconductor substrate, thereby forming a single system-on-chip (SoC) device.

When the antenna block 100 of FIG. 1 is implemented as a PCB device, all of the feed lines for each different frequency band of the antenna block 100 may be connected to one or more IC chips designed to support that frequency band. For example:

All of the feed lines connected to the eight patch antennas 102(1) for the first polarization direction are connected to one or more IC chips designed to support the first frequency band in the first polarization direction;

All of the feed lines connected to the four patch antennas 102(2) for the first polarization direction are connected to one or more IC chips designed to support the second frequency band in the first polarization direction;

All of the feed lines connected to the four patch antennas 102(3) for the first polarization direction are connected to one or more IC chips designed to support the third frequency band in the first polarization direction; and All of the feed lines connected to the sixteen patch antennas 102 for the second polarization direction are connected to one or more IC chips designed to support the common frequency band in the second polarization direction.

Note that, in some implementations, a given IC chip may support two or more different frequency bands.

Figure 2:
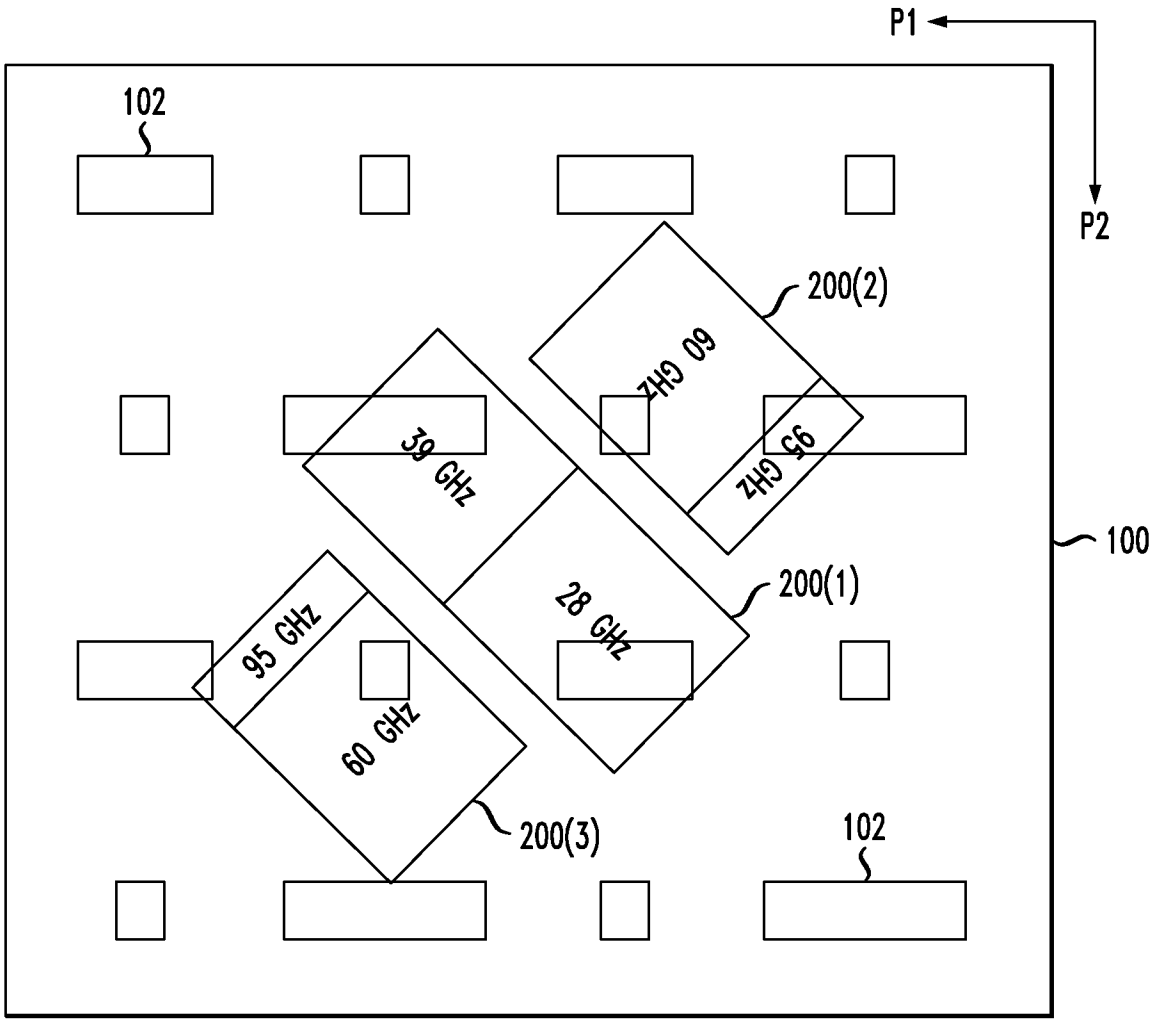
FIG. 2 is an X-ray, plan view the antenna block of FIG. 1 showing the sixteen patch antennas and three IC chips mounted onto the bottom of the antenna block.

FIG. 2 is an X-ray, plan view the antenna block 100 of FIG. 1 showing the sixteen patch antennas 102 and three IC chips 200(1)-200(3) mounted onto the bottom of the antenna block 100 to support the operations of the antenna block 100, where:

IC chip 200(1) is a first type of IC chip that supports the operations of the antenna block 100 in the second (39 GHz) and third (28 GHz) frequency bands in the first polarization direction, where IC chip 200(1) is connected via feed lines (not shown) to all four patch antennas 102(2) and all four patch antennas 102(3); and IC chips 200(2) and 200(3) are two instances of a second type of IC chip that supports the operations of the antenna block 100 in the first (95 GHz) frequency band in the first polarization direction and the common (60 GHz) frequency band in the second polarization direction, where IC chip 200(2) is connected via feed lines (not shown) to four of the eight patch antennas 102(1) for the first frequency band in the first polarization direction and to eight of the sixteen patch antennas 102 for the common frequency band in the second polarization direction, and IC chip 200(3) is connected via feed lines (not shown) to the other four patch antennas 102(1) for the first frequency band in the first polarization direction and to the other eight patch antennas 102 for the common frequency band in the second polarization direction.

Those skilled in the art will understand that (i) two instances of the second type of IC chip are deployed with the first type of IC chip mounted between them and (ii) all three IC chips 200(1)-(3) are mounted at 45-degree angles relative to the first and second polarization directions in order to reduce the overall length and simplify the topology of the feed lines needed to route the electronic signals to and from the sixteen different patch antennas 102. Those skilled in the art will understand that the IC chips 200(1)-(3) can be mounted at angles other than 45 degrees, including 0 degrees.

In addition to the length and width dimensions of the individual patch antennas 102, another important feature of the antenna block 100 of FIG. 1 is the distances between the patch antennas 102. As understood by those skilled in the art, for optimal beamforming, the distance between adjacent patch antennas operating at the same frequency band in an antenna array should be one half the wavelength of the center frequency of that frequency band. Thus:

The distance in the first polarization direction between adjacent patch antennas 102(1) of the first type (labeled A in FIG. 1) should ideally be one half the wavelength of the center frequency of the first frequency band in the first polarization direction;

The distance in the first polarization direction between adjacent patch antennas 102(2) of the second type (labeled B in FIG. 1) should ideally be one half the wavelength of the center frequency of the second frequency band in the first polarization direction;

The distance in the first polarization direction between adjacent patch antennas 102(3) of the third type (labeled C in FIG. 1) should ideally be one half the wavelength of the center frequency of the third frequency band in the first polarization direction; and The distance in the second polarization direction between all adjacent patch antennas 102 (labeled D in FIG. 1) should ideally be one half the wavelength of the center frequency of the common frequency band in the second polarization direction.

For the four particular frequencies supported by the antenna block 100 of FIG. 1, the antenna block 100 can be designed such that:

Distance D is equal to one half the wavelength at 60 GHz;

Distance B is substantially equal to one half the wavelength at 28 GHz; and

Distance C approximately equal to one half the wavelength at 39 GHz.

Note that, while the inter-patch distance A for the patch antennas 102(1) of the first type would be relatively far from ideal in such an implementation of the antenna block 100, some of the sub-optimal beamforming in the first frequency band in the first polarization direction resulting from that sub-optimal inter-patch distance would be compensated for by the fact that there are twice as many patch antennas 102(1) of the first type as there are of each of the other two types. As used herein, the term "inter-patch distance" refers to the distance between the centers of two different patches.

Based on the above-described features, which promote the suppression of inter-band interference, the antenna block 100 of FIG. 1 can be used as a (4×4) antenna array to support communications and/or imaging applications, depending on the type of electronics that are provided to support the operations of the antenna block 100, where, in theory, the antenna array can be operated in the three different frequency bands in the first polarization direction and the common frequency band in the second polarization direction in any combination of transmit and receive modes and in any combination of sequential or simultaneous operation. For example, when configured with electronics that support bi-directional communications, the antenna block 100 can be operated as an antenna array that simultaneously transmits outgoing wireless signals in zero, one, two, three, or all four of the supported frequency bands and receives incoming wireless signals in zero, one, two, three, or all four of the supported frequency bands as long as no frequency band is simultaneously used for both transmission and reception. Similarly, when configured with electronics that support imaging, the antenna block 100 can be operated as an antenna array that simultaneously receives incoming wireless signals in one, two, three, or all four of the supported frequency bands. The antenna block 100 can also be operated in any sequential combination of the four frequency bands in a time-division manner for either communication or imaging applications.

The antenna block 100 of FIG. 1 has a rectangular (in this case, square) peripheral edge, and the center points of the patch antennas 102 in the antenna block 100 form a two-dimensional grid having an outer rectangle of center points. As used herein, the term "two-dimensional" refers to an arrangement in which the dimensions of the arrangement in two orthogonal directions (e.g., length and width) are significantly greater than the dimension of the arrangement in the third orthogonal direction (e.g., thickness). In some implementations, the shortest distance from each center point in the outer rectangle to the peripheral edge of the antenna block 100 is one half of the distance between adjacent center points in the two-dimensional grid. This means that, when two instances of the antenna block 100 are arranged side-by-side, the inter-patch distances between adjacent patch antennas 102 are substantially identical within each antenna block 100 and between the two instances of the antenna block 100.

Figure 3:
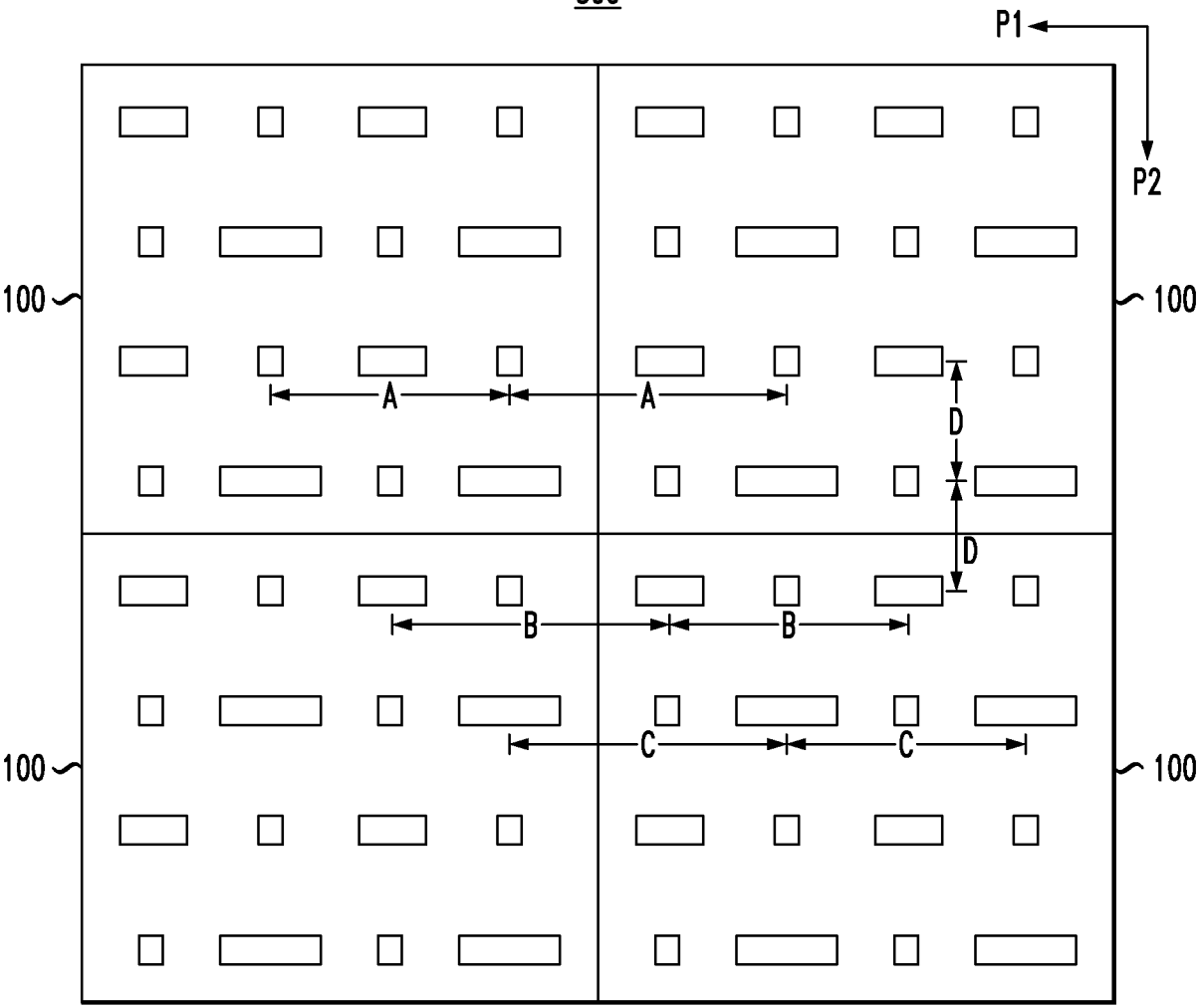
FIG. 3 is an X-ray, plan view of an (8×8) antenna array formed by configuring four instances of the (4×4) antenna block of FIG. 1 as tiles in a (2×2) arrangement.

FIG. 3 is an X-ray, plan view of an (8×8) antenna array 300 formed by configuring four instances of the (4×4) antenna block 100 of FIG. 1 as tiles in a (2×2) arrangement. Note that the antenna block 100 is designed such that the distances A, B, and C of FIG. 1 are maintained across adjacent antenna blocks 100 in the antenna array 300. Thus, multiple instances of the antenna block 100 can be configured as tiles in an arrangement having a square shape, a rectangular shape, or any irregular shape that can be formed using such tiles.

Although the (4×4) antenna block 100 of FIG. 1 has a particular arrangement of the sixteen patch antennas 102, those skilled in the art will understand that other suitable arrangements of those sixteen patch antennas 102 can be used to form a (4×4) antenna block.

Although the (4×4) antenna block 100 of FIG. 1 has been described as a tile that can be used to form larger antenna arrays, such as the (8×8) antenna array 300 of FIG. 3, as few as four of the patch antennas 102 of FIG. 1 can be configured in a (2×2) antenna block that can be used as a tile to form larger antenna arrays, where the (2×2) antenna block corresponds to each of the four quadrants in the antenna block 100 of FIG. 1, such that each (2×2) antenna block would comprise:

Two instances of the first type of patch antenna 102(1);

One instance of the second type of patch antenna 102(2); and

One instance of the third type of patch antenna 102(3).

Note that a (4×4) antenna array equivalent to the antenna block 100 could then be provided by configuring four instances of such a (2×2) antenna block as tiles in a (2×2) arrangement and that an (8×8) antenna array equivalent to the antenna array 300 of FIG. 3 could be provided by configuring sixteen instances of such a (2×2) antenna block as tiles in a (4×4) arrangement.

Figure 4A:
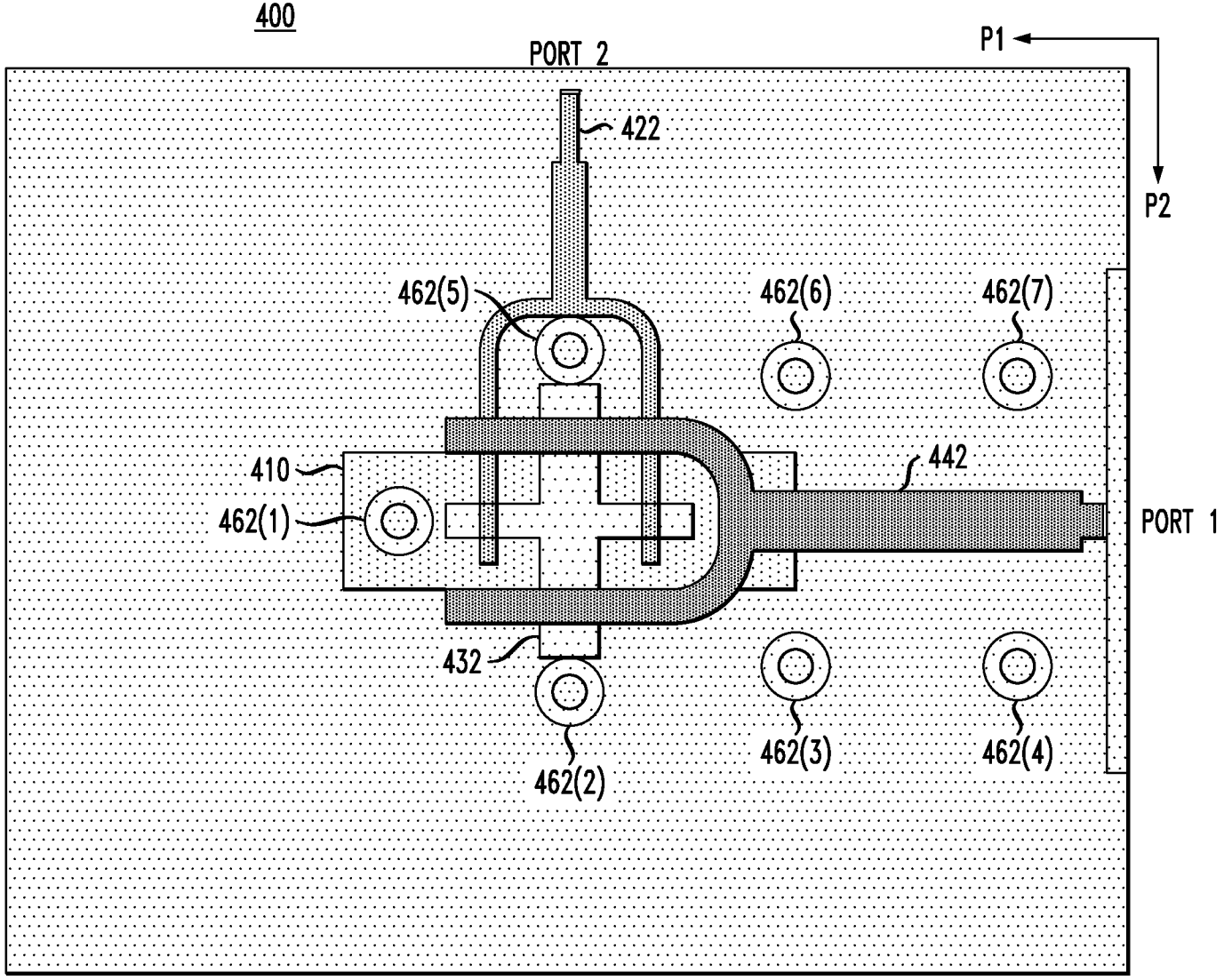
FIG. 4A is an X-ray, plan view of a patch antenna whose general architecture may be employed to construct each of the patch antennas of FIG. 1.
Figure 4B:
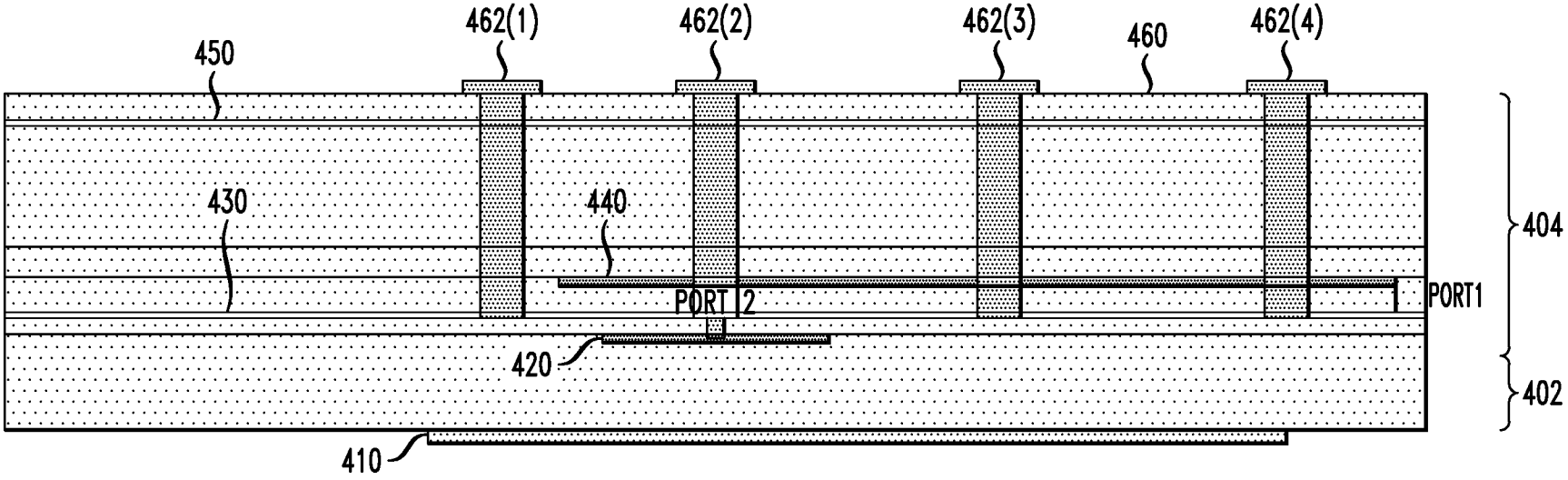
FIG. 4B is an X-ray, side view of the patch antenna of FIG. 4A in the second polarization direction.

FIG. 4A is an X-ray, plan view of a patch antenna 400 whose general architecture may be employed to construct each of the patch antennas 102 of FIG. 1, and FIG. 4B is an X-ray, side view of the patch antenna 400 of FIG. 4A in the second polarization direction. As shown in FIG. 4A, from bottom to top, the patch antenna 400 comprises the following metal layers:

A patch layer 410;

A second feed layer 420;

An aperture layer 430;

A first feed layer 440;

A reflector layer 450; and

A top layer 460, where the metal patch layer 410 is embedded within a first dielectric material 402 having a dielectric constant Dk of about 6, and the four metal layers 420-450 are embedded within a second dielectric material 404 having a dielectric constant Dk of about 3. In addition, the patch antenna 400 has seven vertical metal via structures 462(1)-462(7), where the via structures 462(1), 462(3), 462(4), 462(6), and 462(7) extend from the exposed top layer 460 of the patch antenna 400 down to the aperture layer 430 having bi-directional aperture 432, while the via structures 462(2) and 462(5) extend from the exposed top layer 460 down to the second feed layer 420.

Figure 5A:
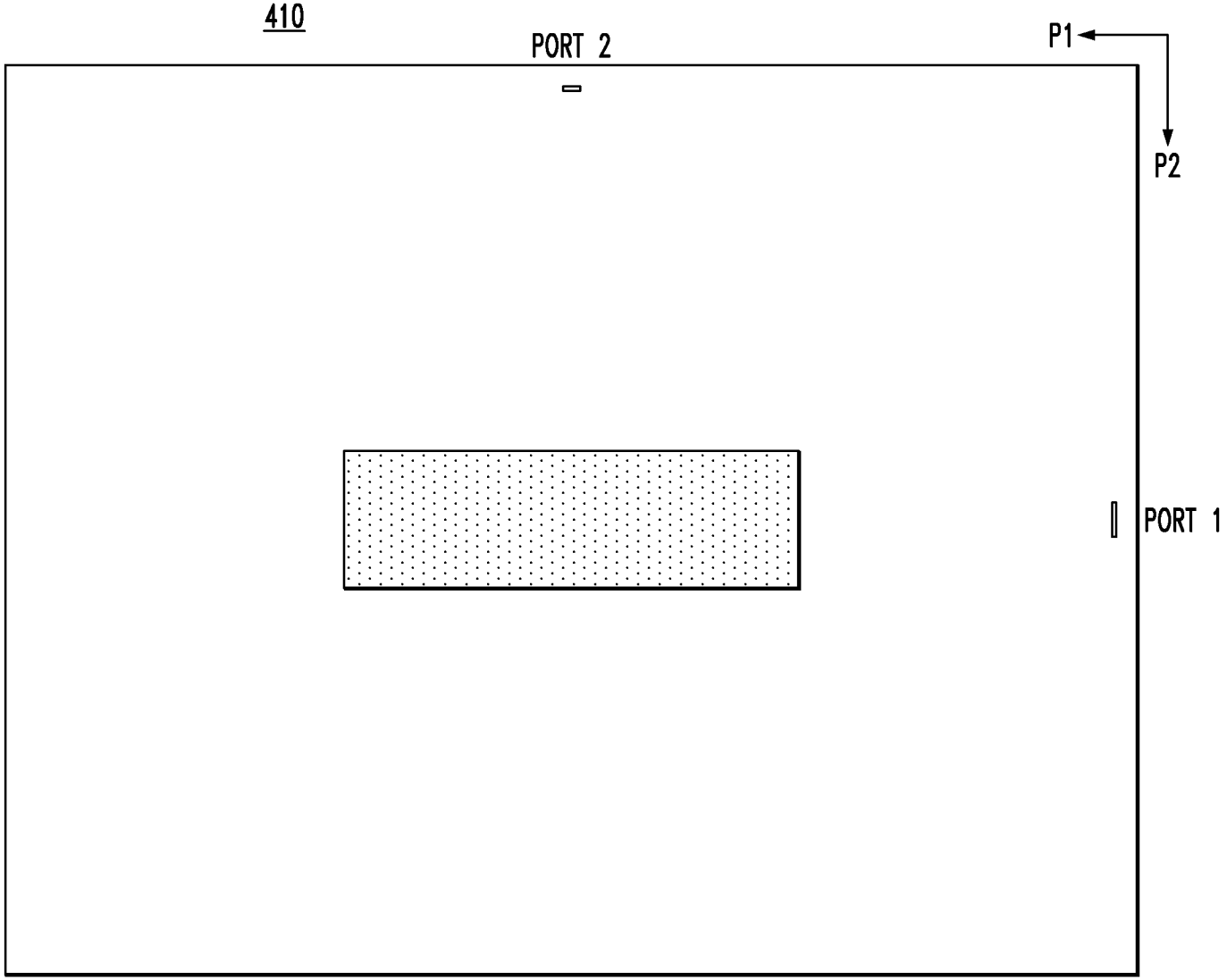
FIGS. 5A-5F show plan views illustrating the different metal layers of the patch antenna of FIGS. 4A-4B.
Figure 5B:
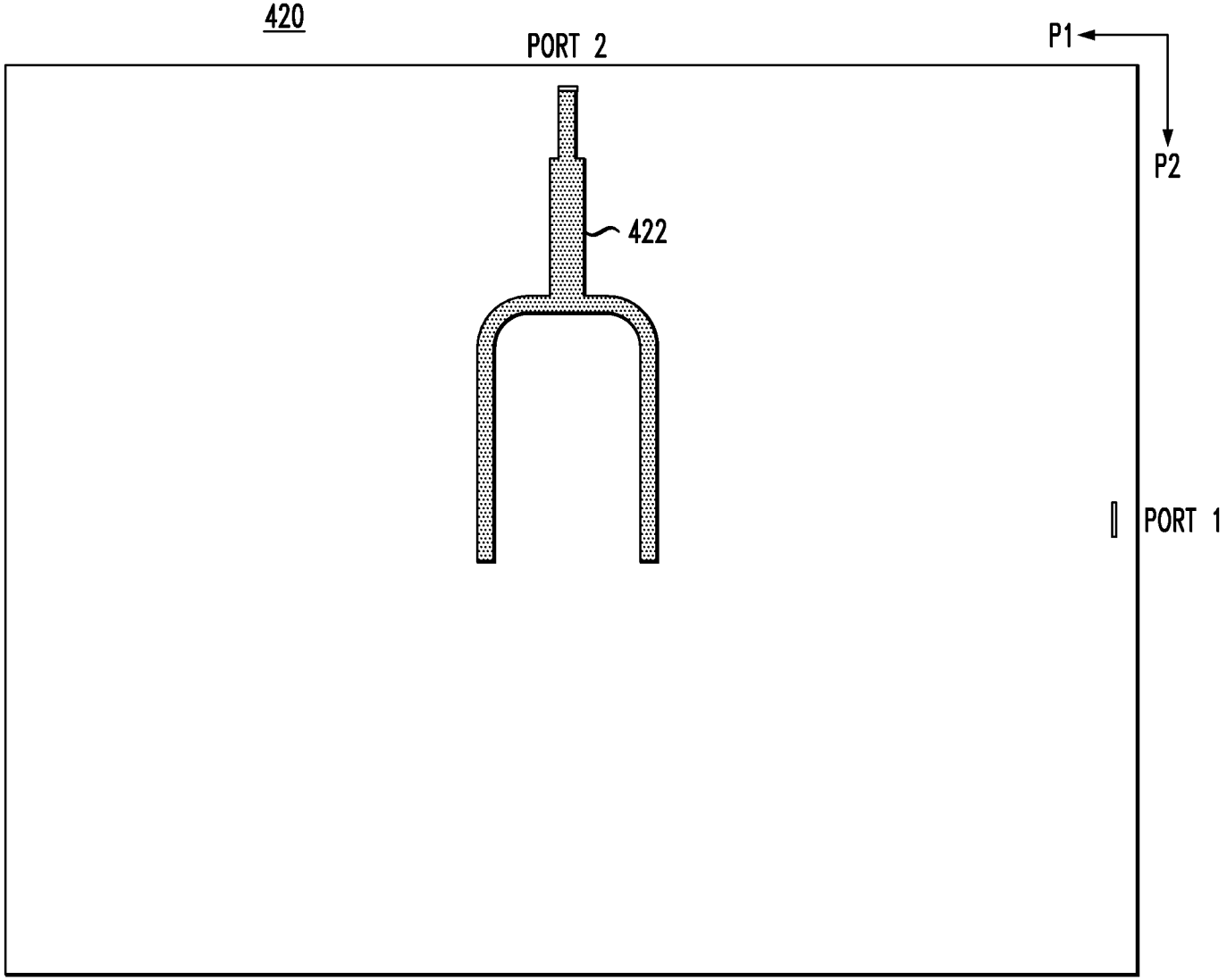
Figure 5C:
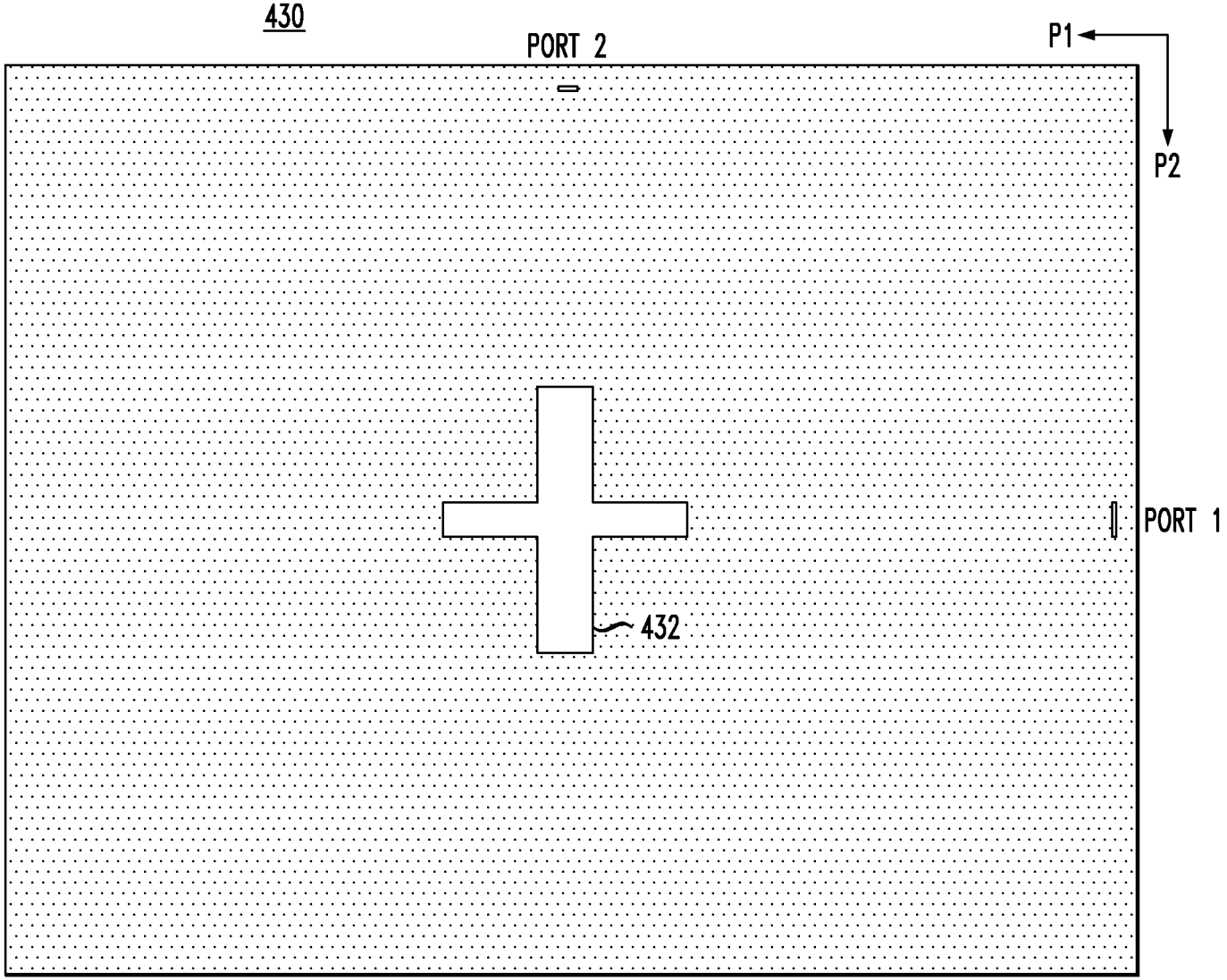
Figure 5D:
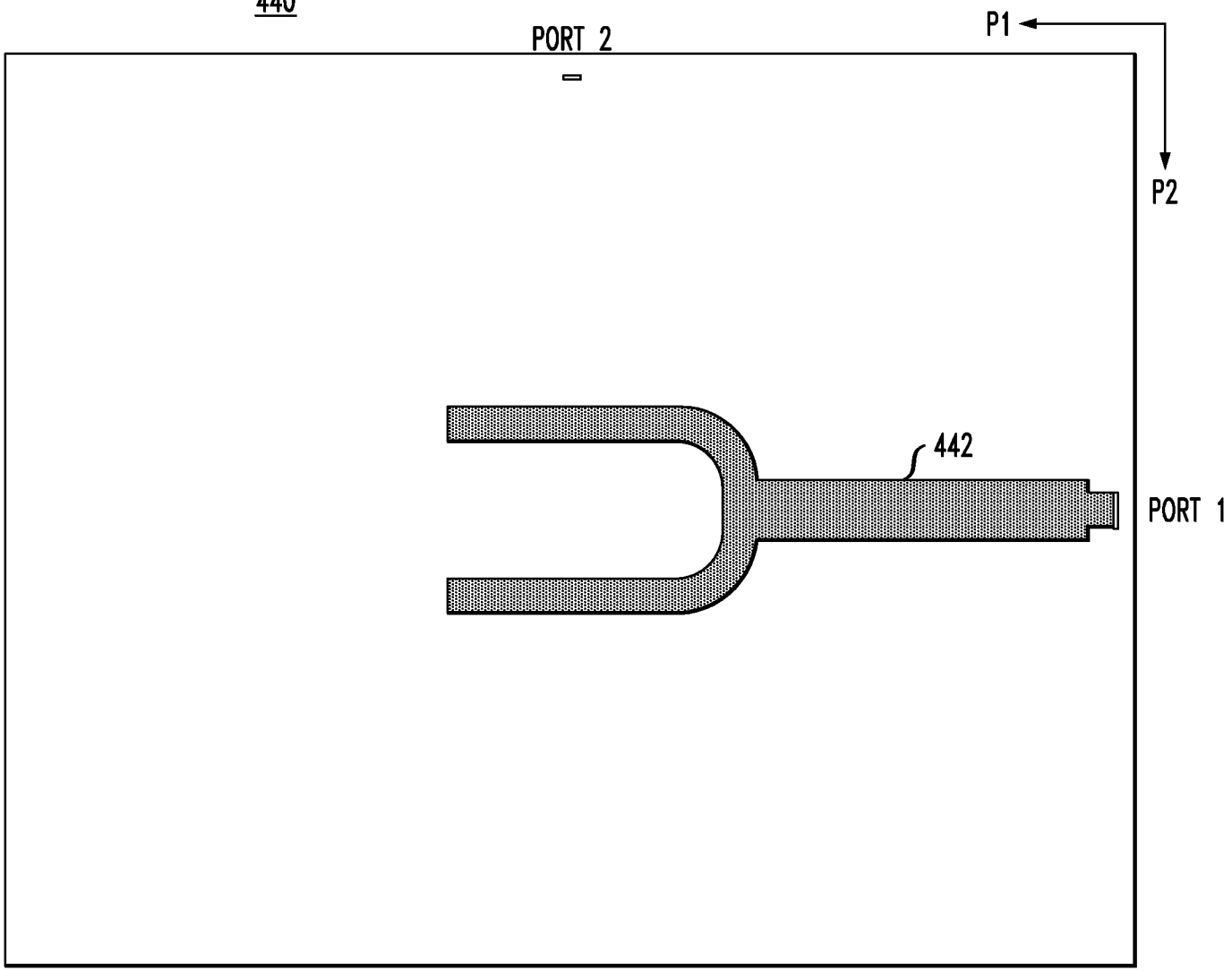
Figure 5E:
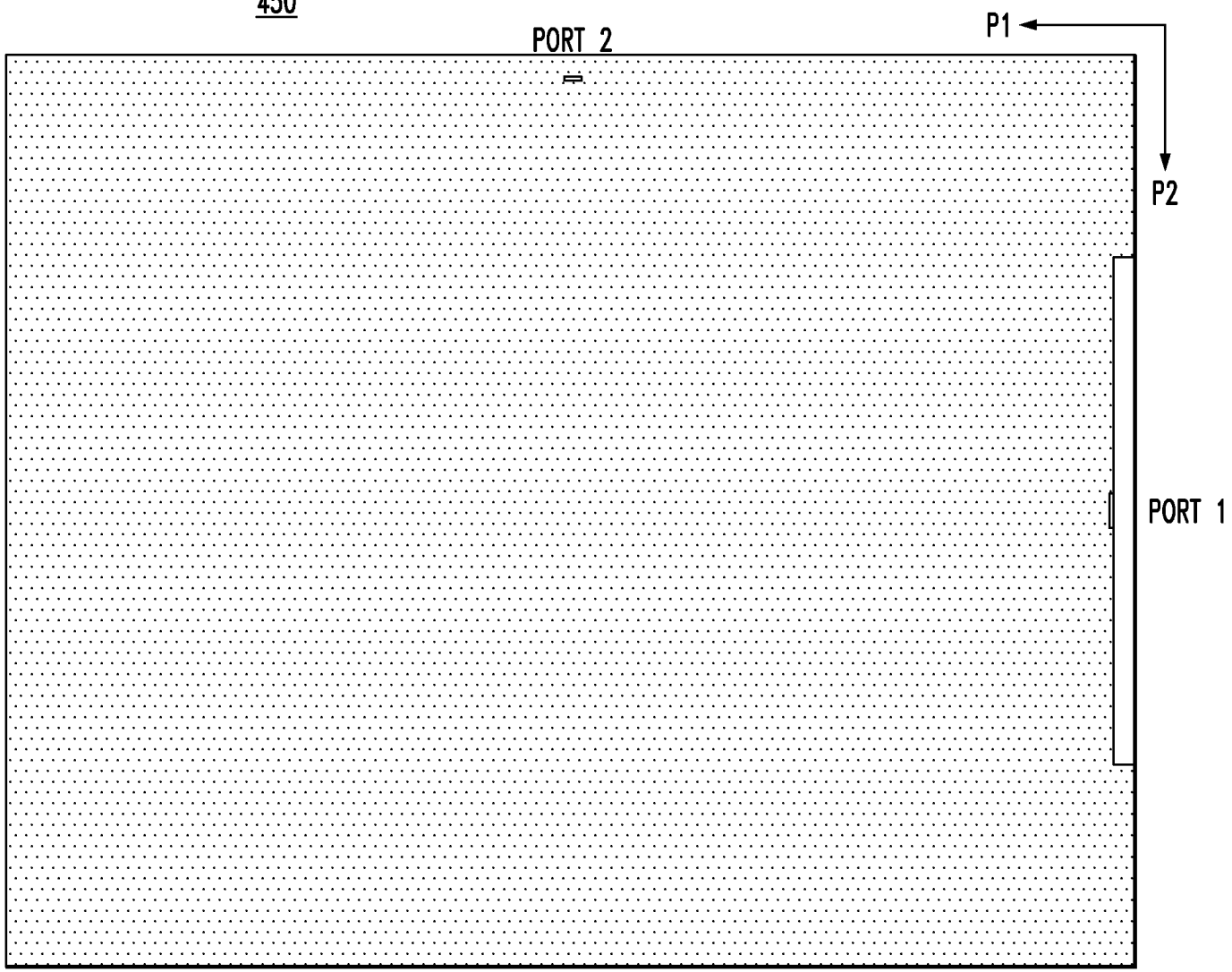
Figure 5F:
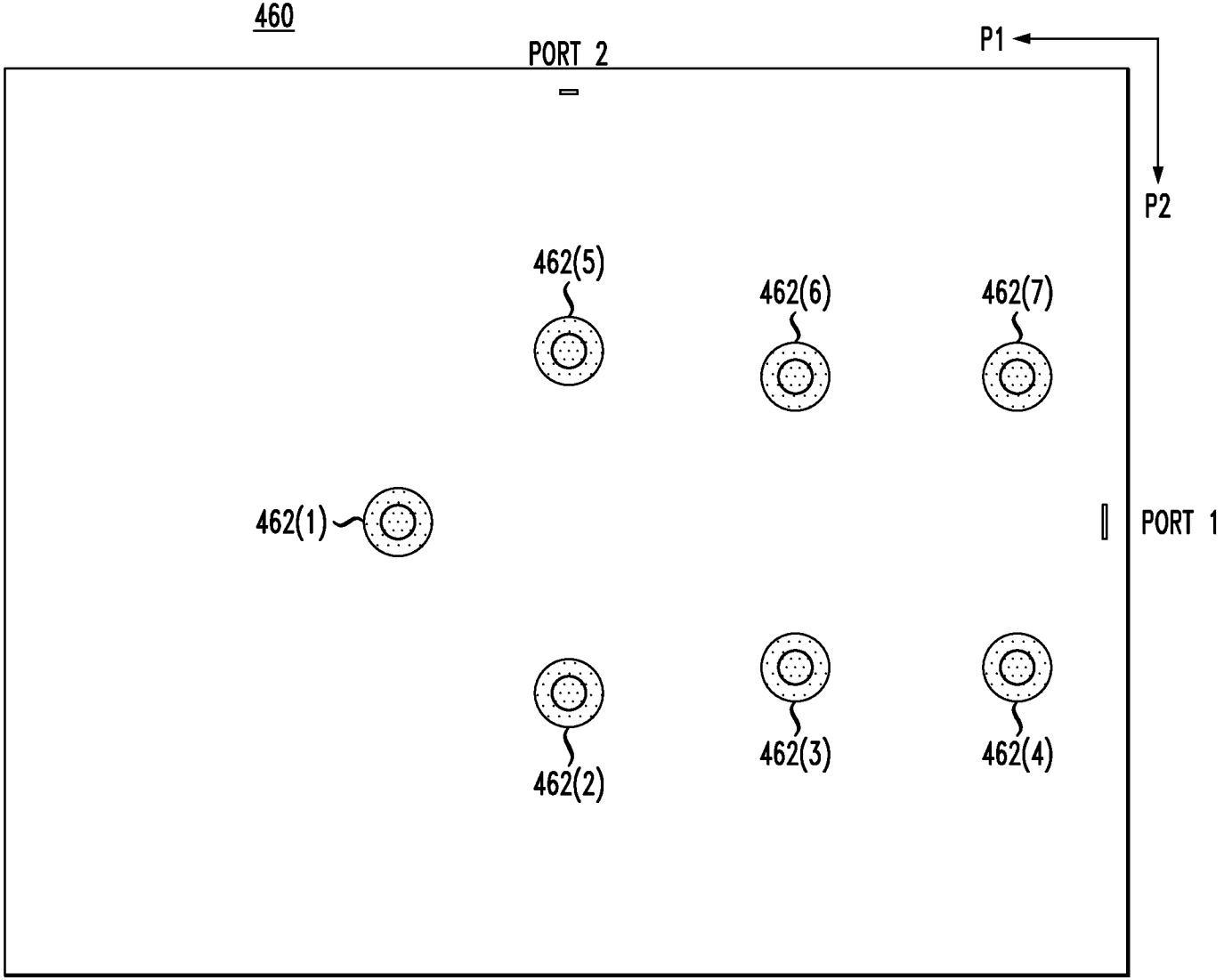

FIGS. 5A-5F shows plan views illustrating the different metal layers 410-460 of the patch antenna 400 of FIGS. 4A-4B. In particular:

FIG. 5A shows a plan view of the patch layer 410 of FIGS. 4A-4B;

FIG. 5B shows a plan view of the feed element 422 in the second feed layer 420 of FIGS. 4A-4B;

FIG. 5C shows a plan view of the aperture layer 430 of FIGS. 4A-4B;

FIG. 5D shows a plan view of the feed element 442 in the first feed layer 440 of FIGS. 4A-4B;

FIG. 5E shows a plan view of the reflector layer 450 of FIGS. 4A-4B; and FIG. 5F shows a plan view of metal portions of the via structures 462(1)-462(7) on the top layer 460 of FIGS. 4A-4B.

Figure 6A:
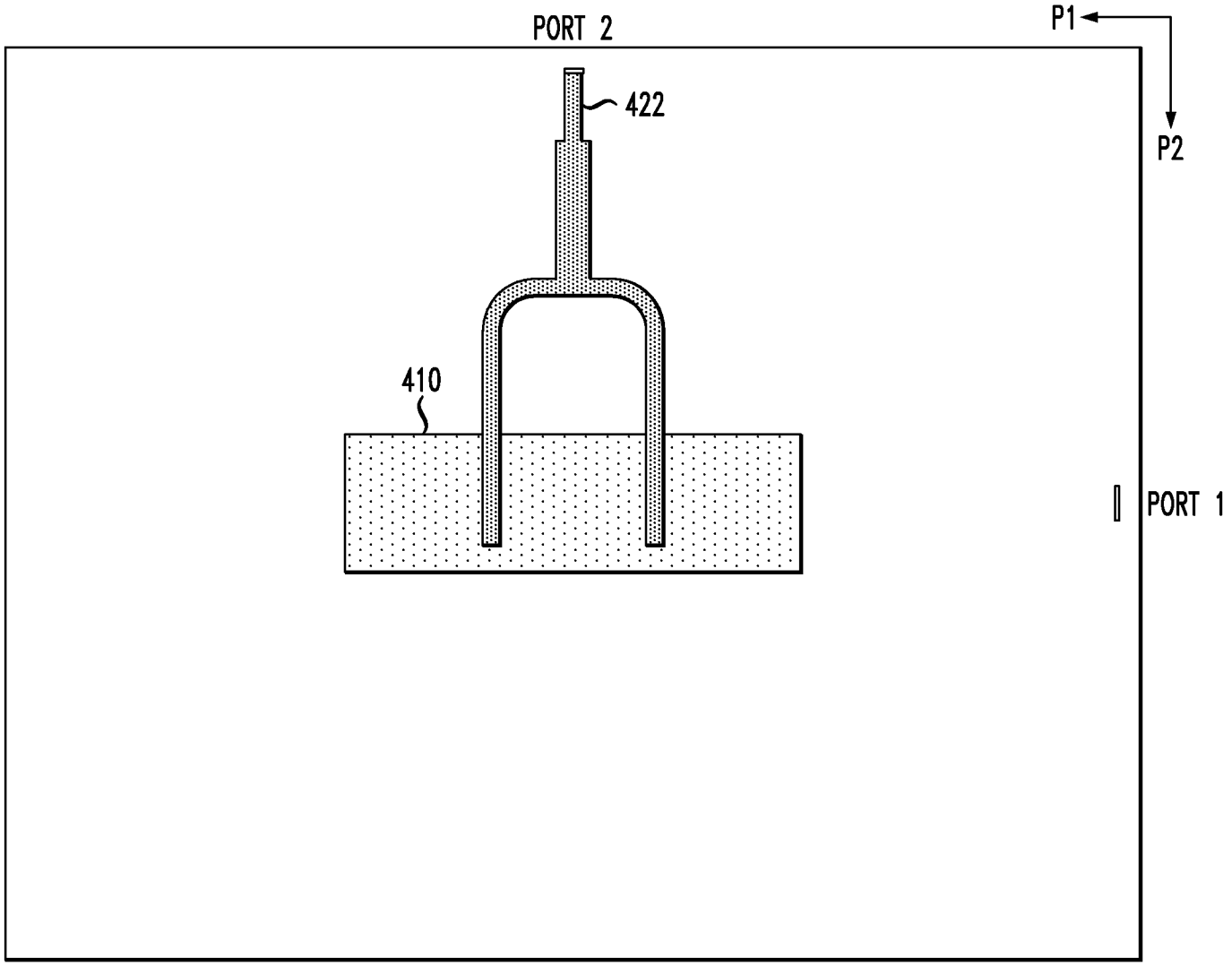
FIGS. 6A-6D show X-ray, plan views illustrating the different metal layers of the patch antenna of FICs. 4A-4B.
Figure 6B:
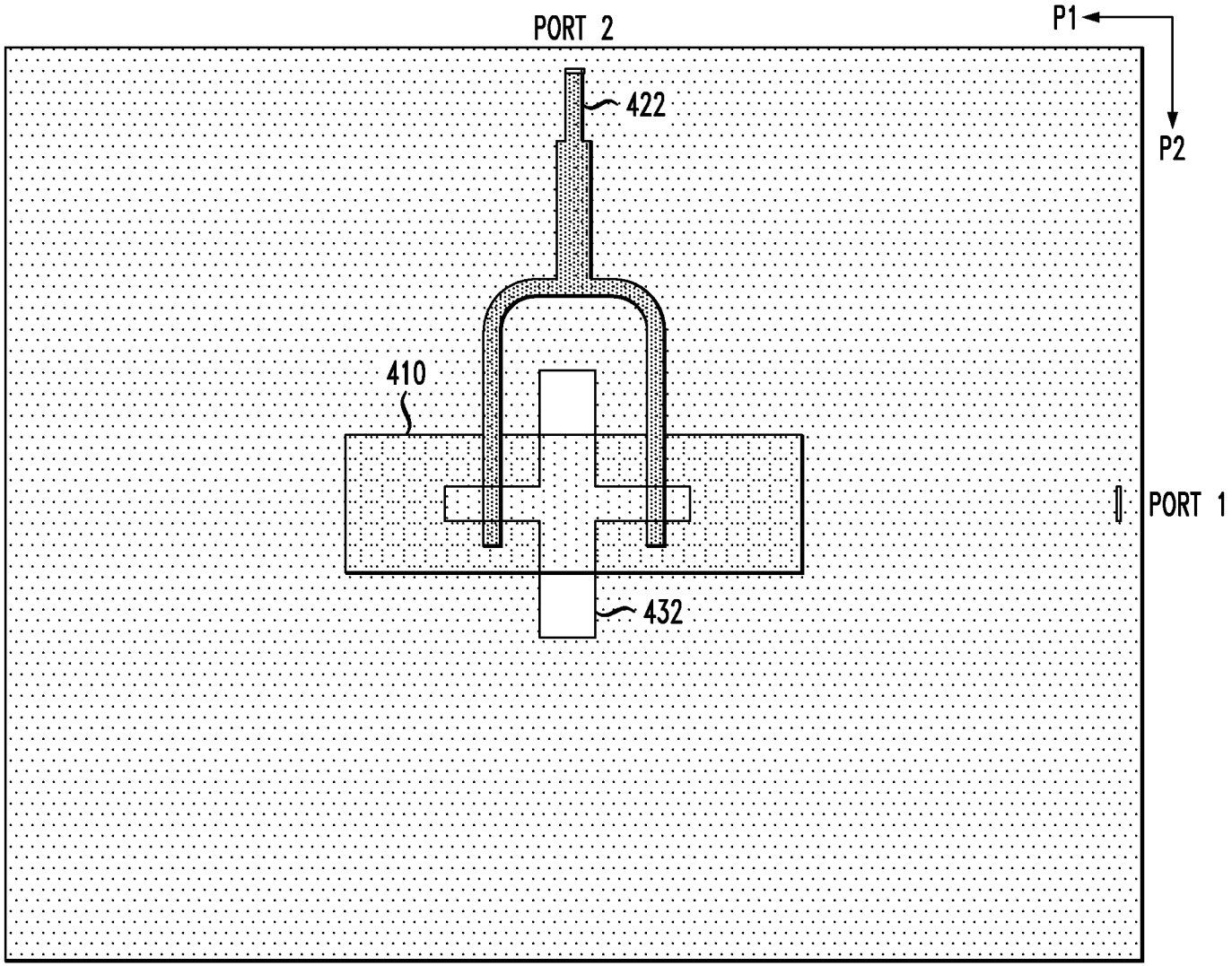
Figure 6C:
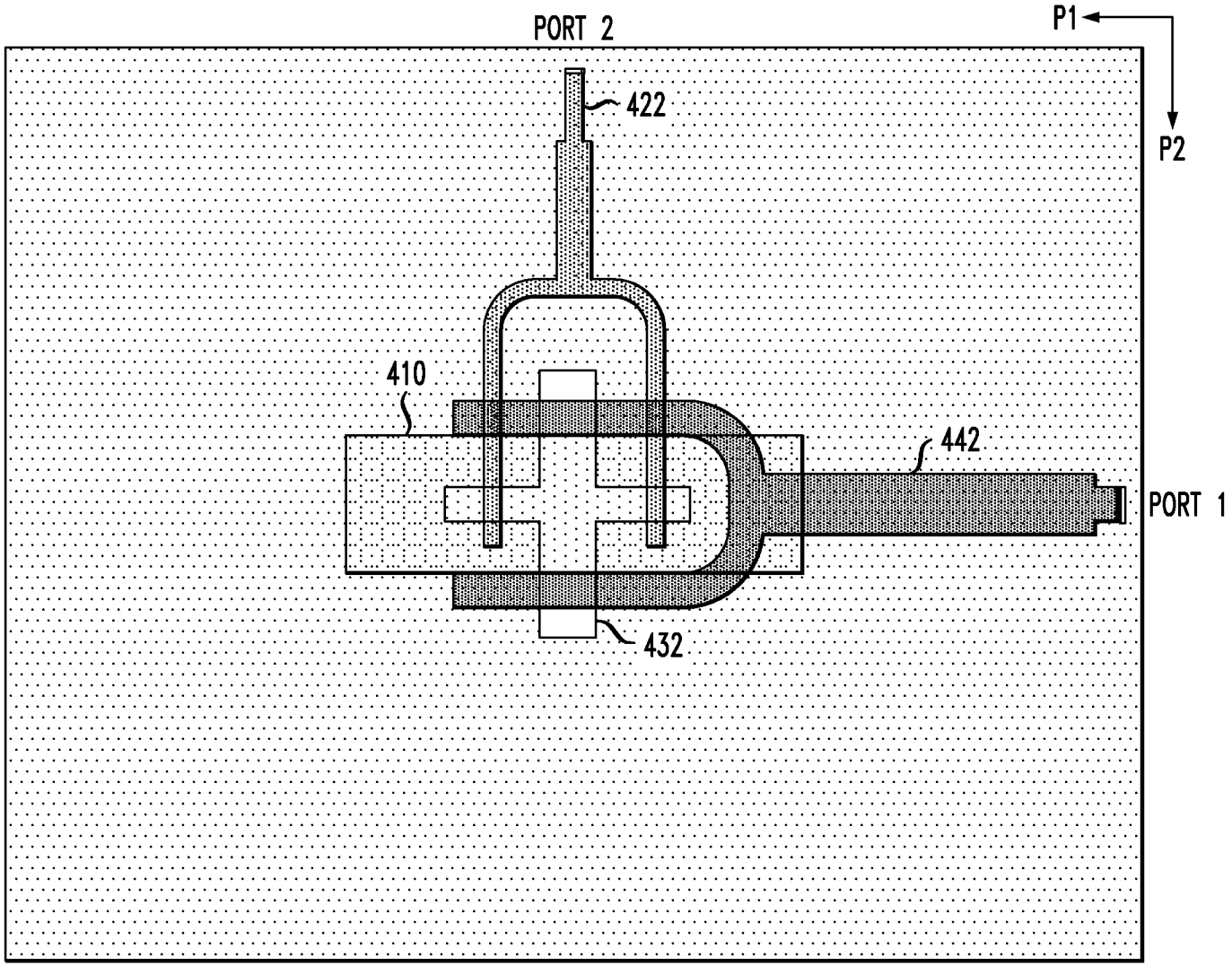
Figure 6D:
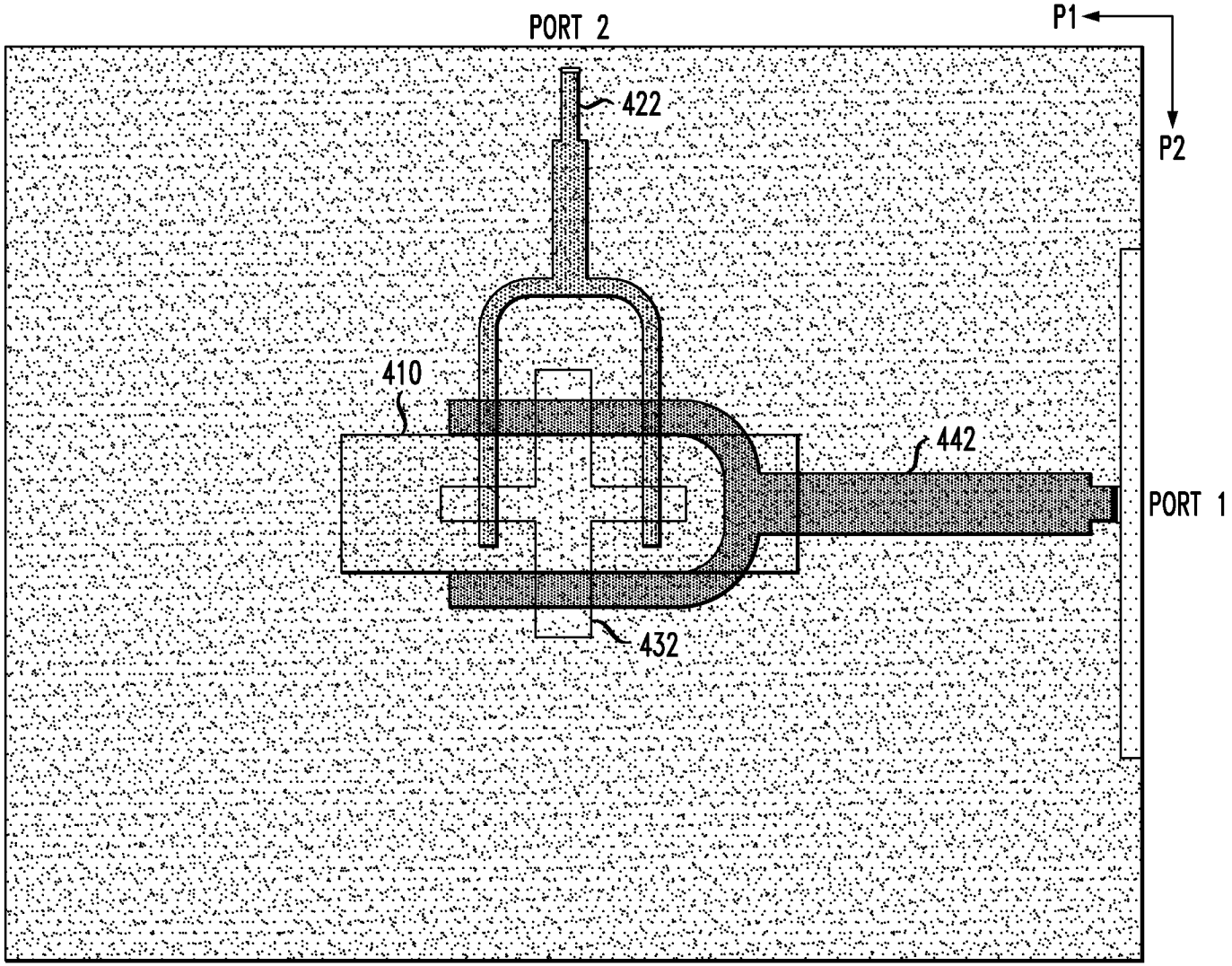

FIGS. 6A-6D show the following X-ray, plan views:

FIG. 6A shows an X-ray, plan view of the second feed layer 420 of FIGS. 4A-4B superposed over the patch layer 410 of FIGS. 4A-4B;

FIG. 6B shows an X-ray, plan view of the aperture layer 430 of FIGS. 4A-4B superposed over the view of FIG. 6A;

FIG. 6C shows an X-ray, plan view of the first feed layer 440 of FIGS. 4A-4B superposed over the view of FIG. 6B; and FIG. 6D shows an X-ray, plan view of the reflector layer 450 of FIGS. 4A-4B superposed over the view of FIG. 6C.

Note that FIG. 4A is an X-ray, plan view of the top layer 460 of FIGS. 4A-4B superposed over the view of FIG. 6D.

Although the three different types of patch antennas 102 of FIG. 1 have been described in the context of four different frequency bands having four specific center frequencies, those skilled in the art will understand that alternative implementations can be provided for one, two, three, or four center frequencies that differ from those of the patch antennas 102.

Although the four different frequencies supported by the antenna block 100 of FIG. 1 include three frequency bands in a first polarization direction and one frequency band in the a second polarization direction, other implementations may be designed to have two different frequency bands in each of the two different polarization directions.

Although the antenna block 100 of FIG. 1 supports four different frequency bands, antenna blocks of the disclosure may support three or more different frequency bands. At a minimum, an antenna block of the disclosure has two different types of dual-band, dual polarization patch antennas that support a common frequency band in one polarization direction and two different frequency bands in the other polarization direction. At a maximum, in theory, an antenna block of the disclosure having N different types of dual-band, dual-polarization patch antennas can support up to 2N different frequency bands, where each type of patch antenna in the antenna block supports two different frequency bands in the two polarization directions. Those skilled in the art will understand that the antenna block 100 of FIG. 1 falls between those minimum and maximum embodiments, where the antenna block 100 has three different types of dual-band, dual polarization patch antennas that support four different frequency bands.

Although antenna blocks have been described having square arrangements of patch antennas, in alternative embodiments, antenna blocks may have non-square rectangular arrangements of patch antennas. For example, any two adjacent rows of patch antennas 102 in FIG. 1 could be used to form a (2×4) antenna block of the disclosure. Similarly, any two adjacent columns of patch antennas in FIG. 1 could be used to form a (4×2) antenna block of the disclosure.

According to certain embodiments, an article of manufacture comprises an antenna block comprising a substrate; one or more instances of a first type of dual-band, dual-polarization patch antenna formed on the substrate, wherein the first type of patch antenna is configured to support a first frequency band in a first polarization direction and a first frequency band in a second polarization direction, wherein the first frequency band in the first polarization direction is different from the first frequency band in the second polarization direction; one or more instances of a second type of dual-band, dual-polarization patch antenna formed on the substrate, wherein the second type of patch antenna is configured to support a second frequency band in the first polarization direction and a second frequency band in the second polarization direction, wherein (i) the second frequency band in the second polarization direction is different from the second frequency band in the first polarization direction and (ii) the second frequency band in the first polarization direction is different from the first frequency band in the first polarization direction; a first feed line formed on the substrate and connected to support the first frequency band in the first polarization direction; and a different, second feed line formed on the substrate and connected to support the second frequency band in the first polarization direction.

According to certain embodiments of the foregoing, the first and second frequency bands in the second polarization direction are equal to a common frequency band in the second polarization direction; and the antenna block further comprises a different, third feed line formed on the substrate and connected to support the common frequency band in the second polarization direction.

According to certain embodiments of the foregoing, the antenna block further comprises one or more instances of a third type of dual-band, dual-polarization patch antenna formed on the substrate, wherein the third type of patch antenna is configured to support a third frequency band in the first polarization direction and a third frequency band in the second polarization direction, wherein (i) the third frequency band in the second polarization direction is different from the third frequency band in the first polarization direction and (ii) the third frequency band in the first polarization direction is different from the first and second frequency bands in the first polarization direction; and a different, third feed line formed on the substrate and connected to support the third frequency band in the first polarization direction.

According to certain embodiments of the foregoing, the first, second, and third frequency bands in the second polarization direction are equal to a common frequency band in the second polarization direction; and the antenna block further comprises a different, fourth feed line formed on the substrate and connected to support the common frequency band in the second polarization direction.

According to certain embodiments of the foregoing, the antenna block comprises a (2×2) arrangement of patch antennas comprising two instances of the first type of patch antenna located at opposing corners of the (2×2) arrangement; one instance of the second type of patch antenna; and one instance of the third type of patch antenna.

According to certain embodiments of the foregoing, the antenna block comprises a (4×4) arrangement of patch antennas comprising eight instances of the first type of patch antenna; four instances of the second type of patch antenna; and four instances of the third type of patch antenna.

According to certain embodiments of the foregoing, the article further comprises one instance of a first type of integrated circuit (IC) chip configured to support operations of the antenna block in the second and third frequency bands in the first polarization direction; and two instances of a second type of IC chip configured to support operations of the antenna block in the first frequency band in the first polarization direction and in the common frequency band in the second polarization direction.

According to certain embodiments of the foregoing, each of the three IC chips is mounted onto the antenna block at a non-zero-degree angle relative to rows and columns of the patch antennas in the antenna block.

According to certain embodiments of the foregoing, the article comprises a multi-band antenna array comprising a plurality of instances of the antenna block arranged in a two-dimensional pattern.

According to certain embodiments of the foregoing, the multi-band antenna array comprises a first antenna block and a second antenna block arranged side-by-side, wherein inter-patch distances are substantially identical (i) between adjacent patch antennas within each antenna block and (ii) between adjacent patch antennas between the first antenna block and the second antenna block.

According to certain embodiments of the foregoing, the antenna block has a rectangular peripheral edge; the center points of the patch antennas in the antenna block form a two-dimensional grid having an outer rectangle of center points; and the shortest distance from each center point in the outer rectangle to the peripheral edge of the antenna block is one half of the distance between adjacent center points in the two-dimensional grid.

According to certain embodiments of the foregoing, the substrate is a printed circuit board (PCB) substrate; and one or more integrated circuit (IC) chips are mounted onto the PCB substrate and configured to support operations of the antenna block.

For purposes of this description, the terms "couple," "coupling," "coupled," "connect," "connecting," or "connected" refer to any manner known in the art or later developed in which energy is allowed to be transferred between two or more elements, and the interposition of one or more additional elements is contemplated, although not required. Conversely, the terms "directly coupled," "directly connected," etc., imply the absence of such additional elements.

Signals and corresponding terminals, nodes, ports, or paths may be referred to by the same name and are interchangeable for purposes here.

Unless explicitly stated otherwise, each numerical value and range should be interpreted as being approximate as if the word "about" or "approximately" preceded the value or range.

It will be further understood that various changes in the details, materials, and arrangements of the parts which have been described and illustrated in order to explain embodiments of this disclosure may be made by those skilled in the art without departing from embodiments of the disclosure encompassed by the following claims.

In this specification including any claims, the term "each" may be used to refer to one or more specified characteristics of a plurality of previously recited elements or steps. When used with the open-ended term "comprising," the recitation of the term "each" does not exclude additional, unrecited elements or steps. Thus, it will be understood that an apparatus may have additional, unrecited elements and a method may have additional, unrecited steps, where the additional, unrecited elements or steps do not have the one or more specified characteristics.

The use of figure numbers and/or figure reference labels in the claims is intended to identify one or more possible embodiments of the claimed subject matter in order to facilitate the interpretation of the claims. Such use is not to be construed as necessarily limiting the scope of those claims to the embodiments shown in the corresponding figures.

Reference herein to "one embodiment" or "an embodiment" means that a particular feature, structure, or characteristic described in connection with the embodiment can be included in at least one embodiment of the disclosure. The appearances of the phrase "in one embodiment" in various places in the specification are not necessarily all referring to the same embodiment, nor are separate or alternative embodiments necessarily mutually exclusive of other embodiments. The same applies to the term "implementation."

The embodiments covered by the claims in this application are limited to embodiments that (1) are enabled by this specification and (2) correspond to statutory subject matter. Non-enabled embodiments and embodiments that correspond to non-statutory subject matter are explicitly disclaimed even if they fall within the scope of the claims.

As used in this application, the term "circuitry" may refer to one or more or all of the following: (a) hardware-only circuit implementations (such as implementations in only analog and/or digital circuitry); (b) combinations of hardware circuits and software, such as (as applicable): (i) a combination of analog and/or digital hardware circuit(s) with software/firmware and (ii) any portions of hardware processor(s) with software (including digital signal processor(s)), software, and memory(ies) that work together to cause an apparatus, such as a mobile phone or server, to perform various functions); and (c) hardware circuit(s) and or processor(s), such as a microprocessor(s) or a portion of a microprocessor(s), that requires software (e.g., firmware) for operation, but the software may not be present when it is not needed for operation." This definition of circuitry applies to all uses of this term in this application, including in any claims. As a further example, as used in this application, the term circuitry also covers an implementation of merely a hardware circuit or processor (or multiple processors) or portion of a hardware circuit or processor and its (or their) accompanying software and/or firmware. The term circuitry also covers, for example and if applicable to the particular claim element, a baseband integrated circuit or processor integrated circuit for a mobile device or a similar integrated circuit in server, a cellular network device, or other computing or network device.

Unless otherwise specified herein, the use of the ordinal adjectives "first," "second," "third," etc., to refer to an object of a plurality of like objects merely indicates that different instances of such like objects are being referred to, and is not intended to imply that the like objects so referred-to have to be in a corresponding order or sequence, either temporally, spatially, in ranking, or in any other manner.

What is claimed is:

1. An article of manufacture comprising an antenna block comprising:

a substrate;

one or more instances of a first type of dual-band, dual-polarization patch antenna formed on the substrate, wherein the first type of patch antenna is configured to support a first frequency band in a first polarization direction and a first frequency band in a second polarization direction, wherein the first frequency band in the first polarization direction is different from the first frequency band in the second polarization direction;

one or more instances of a second type of dual-band, dual-polarization patch antenna formed on the substrate, wherein the second type of patch antenna is configured to support a second frequency band in the first polarization direction and a second frequency band in the second polarization direction, wherein (i) the second frequency band in the second polarization direction is different from the second frequency band in the first polarization direction and (ii) the second frequency band in the first polarization direction is different from the first frequency band in the first polarization direction;

a first feed line formed on the substrate and connected to support the first frequency band in the first polarization direction;

a different, second feed line formed on the substrate and connected to support the second frequency band in the first polarization direction;

one or more instances of a third type of dual-band, dual-polarization patch antenna formed on the substrate, wherein the third type of patch antenna is configured to support a third frequency band in the first polarization direction and a third frequency band in the second polarization direction, wherein (i) the third frequency band in the second polarization direction is different from the third frequency band in the first polarization direction and (ii) the third frequency band in the first polarization direction is different from the first and second frequency bands in the first polarization direction; and a different, third feed line formed on the substrate and connected to support the third frequency band in the first polarization direction.

2. The article of claim 1, wherein:

the first and second frequency bands in the second polarization direction are equal to a common frequency band in the second polarization direction; and the antenna block further comprises a different, fourth feed line formed on the substrate and connected to support the common frequency band in the second polarization direction.

3. The article of claim 1, wherein:

the first, second, and third frequency bands in the second polarization direction are equal to a common frequency band in the second polarization direction; and the antenna block further comprises a different, fourth feed line formed on the substrate and connected to support the common frequency band in the second polarization direction.

4. The article of claim 3, wherein the antenna block comprises a (2×2) arrangement of patch antennas comprising:

two instances of the first type of patch antenna located at opposing corners of the (2×2) arrangement;

one instance of the second type of patch antenna; and one instance of the third type of patch antenna.

5. The article of claim 3, wherein the antenna block comprises a (4×4) arrangement of patch antennas comprising:

eight instances of the first type of patch antenna;

four instances of the second type of patch antenna; and four instances of the third type of patch antenna.

6. The article of claim 5, further comprising:

one instance of a first type of integrated circuit (IC) chip configured to support operations of the antenna block in the second and third frequency bands in the first polarization direction; and two instances of a second type of IC chip configured to support operations of the antenna block in the first frequency band in the first polarization direction and in the common frequency band in the second polarization direction.

7. The article of claim 6, wherein each of the three IC chips is mounted onto the antenna block at a non-zero-degree angle relative to rows and columns of the patch antennas in the antenna block.

8. The article of claim 1, wherein the article comprises a multi-band antenna array comprising a plurality of instances of the antenna block arranged in a two-dimensional pattern.

9. The article of claim 8, wherein the multi-band antenna array comprises a first antenna block and a second antenna block arranged side-by-side, wherein inter-patch distances are substantially identical (i) between adjacent patch antennas within each antenna block and (ii) between adjacent patch antennas between the first antenna block and the second antenna block.

10. The article of claim 1, wherein:

the antenna block has a rectangular peripheral edge;

the center points of the patch antennas in the antenna block form a two-dimensional grid having an outer rectangle of center points; and the shortest distance from each center point in the outer rectangle to the peripheral edge of the antenna block is one half of the distance between adjacent center points in the two-dimensional grid.

11. The article of claim 1, wherein:

the substrate is a printed circuit board (PCB) substrate; and one or more integrated circuit (IC) chips are mounted onto the PCB substrate and configured to support operations of the antenna block.

12. The article of claim 1, wherein:

the first, second, and third frequency bands in the second polarization direction are equal to a common frequency band in the second polarization direction;

the antenna block further comprises a different, fourth feed line formed on the substrate and connected to support the common frequency band in the second polarization direction;

the antenna block has a rectangular peripheral edge;

the center points of the patch antennas in the antenna block form a two-dimensional grid having an outer rectangle of center points;

the shortest distance from each center point in the outer rectangle to the peripheral edge of the antenna block is one half of the distance between adjacent center points in the two-dimensional grid;

the substrate is a PCB substrate; and one or more IC chips are mounted onto the PCB substrate and configured to support operations of the antenna block.

13. The article of claim 12, wherein the antenna block comprises a (2×2) arrangement of patch antennas comprising:

two instances of the first type of patch antenna located at opposing corners of the (2×2) arrangement;

one instance of the second type of patch antenna; and one instance of the third type of patch antenna.

14. The article of claim 12, wherein:

the antenna block comprises a (4×4) arrangement of patch antennas comprising:

eight instances of the first type of patch antenna;

four instances of the second type of patch antenna; and four instances of the third type of patch antenna;

the article further comprises:

one instance of a first type of IC chip configured to support operations of the antenna block in the second and third frequency bands in the first polarization direction; and two instances of a second type of IC chip configured to support operations of the antenna block in the first frequency band in the first polarization direction and in the common frequency band in the second polarization direction, wherein each of the three IC chips is mounted onto the antenna block at a non-zero-degree angle relative to rows and columns of the patch antennas in the antenna block.

15. The article of claim 12, wherein the article comprises a multi-band antenna array comprising a plurality of instances of the antenna block arranged in a two-dimensional pattern, wherein the multi-band antenna array comprises a first antenna block and a second antenna block arranged side-by-side, wherein inter-patch distances are substantially identical (i) between adjacent patch antennas within each antenna block and (ii) between adjacent patch antennas between the first antenna block and the second antenna block.

16. An article of manufacture comprising an antenna block comprising:

a substrate;

one or more instances of a first type of dual-band, dual-polarization patch antenna formed on the substrate, wherein the first type of patch antenna is configured to support a first frequency band in a first polarization direction and a first frequency band in a second polarization direction, wherein the first frequency band in the first polarization direction is different from the first frequency band in the second polarization direction;

one or more instances of a second type of dual-band, dual-polarization patch antenna formed on the substrate, wherein the second type of patch antenna is configured to support a second frequency band in the first polarization direction and a second frequency band in the second polarization direction, wherein (i) the second frequency band in the second polarization direction is different from the second frequency band in the first polarization direction and (ii) the second frequency band in the first polarization direction is different from the first frequency band in the first polarization direction;

a first feed line formed on the substrate and connected to support the first frequency band in the first polarization direction; and a different, second feed line formed on the substrate and connected to support the second frequency band in the first polarization direction, wherein:

the first and second frequency bands in the second polarization direction are equal to a common frequency band in the second polarization direction; and the antenna block further comprises a different, third feed line formed on the substrate and connected to support the common frequency band in the second polarization direction.

* * * * *